US009105235B2

(12) United States Patent
Kwon et al.

(10) Patent No.: US 9,105,235 B2
(45) Date of Patent: Aug. 11, 2015

(54) METHODS OF DRIVING ACTIVE DISPLAY DEVICE

(75) Inventors: Dae-woong Kwon, Seoul (KR); Byung-gook Park, Seoul (KR); Chang-jung Kim, Yongin-si (KR); Jae-chul Park, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 182 days.

(21) Appl. No.: 13/219,959

(22) Filed: Aug. 29, 2011

(65) Prior Publication Data

US 2012/0113078 A1 May 10, 2012

(30) Foreign Application Priority Data

Nov. 9, 2010 (KR) ..... 10-2010-0111121

(51) Int. Cl.
*G09G 3/30* (2006.01)
*G09G 3/32* (2006.01)

(52) U.S. Cl.
CPC ..... *G09G 3/3233* (2013.01); *G09G 2300/0842* (2013.01); *G09G 2310/0251* (2013.01)

(58) Field of Classification Search
CPC ..... G09G 3/10; G09G 3/30; G09G 3/32; G09G 5/00; G09G 3/3233; G09G 2300/0842; G09G 2310/0251; G02F 1/13306; G06F 3/038
USPC ..... 345/76, 92, 211, 77, 87, 208, 82; 315/169.3
See application file for complete search history.

(56) References Cited

U.S. PATENT DOCUMENTS

| | | | | |
|---|---|---|---|---|
| 6,307,322 | B1 * | 10/2001 | Dawson et al. | 315/169.1 |
| 6,680,580 | B1 * | 1/2004 | Sung | 315/169.3 |
| 6,858,989 | B2 * | 2/2005 | Howard | 315/169.1 |
| 7,091,940 | B2 * | 8/2006 | Tsujimura et al. | 345/82 |
| 7,515,146 | B2 * | 4/2009 | Hayafuji | 345/204 |
| 7,525,119 | B2 * | 4/2009 | Koyama | 257/59 |
| 7,605,789 | B2 * | 10/2009 | Uchino et al. | 345/92 |
| 7,821,478 | B2 * | 10/2010 | Tsuchida | 345/76 |
| 7,965,263 | B2 * | 6/2011 | Parikh et al. | 345/76 |
| 8,248,341 | B2 * | 8/2012 | Neugebauer | 345/87 |
| 8,362,984 | B2 * | 1/2013 | Le Roy et al. | 345/82 |
| 8,378,938 | B2 * | 2/2013 | Nathan et al. | 345/78 |

(Continued)

FOREIGN PATENT DOCUMENTS

| | | |
|---|---|---|
| JP | 1995-045846 | 2/1995 |
| JP | 2003150108 A | 5/2003 |
| JP | 2005195777 A | 7/2005 |

(Continued)

*Primary Examiner* — Lun-Yi Lao
*Assistant Examiner* — Johny Lau
(74) *Attorney, Agent, or Firm* — Harness, Dickey & Pierce

(57) ABSTRACT

A method of driving an active display device. The method including recovering a threshold voltage of a switching transistor connected to a pixel. The recovering including applying a negative bias voltage to the switching transistor prior to charging each pixel during a charging period. The negative bias voltage is applied to a drain of the switching transistor.

8 Claims, 6 Drawing Sheets

(56) References Cited

U.S. PATENT DOCUMENTS

| | | | | |
|---|---|---|---|---|
| 2003/0052614 | A1* | 3/2003 | Howard | 315/169.1 |
| 2003/0210212 | A1* | 11/2003 | Li et al. | 345/76 |
| 2004/0252089 | A1* | 12/2004 | Ono et al. | 345/82 |
| 2005/0030265 | A1* | 2/2005 | Miyagawa | 345/76 |
| 2006/0109264 | A1 | 5/2006 | Hirai et al. | |
| 2006/0113918 | A1 | 6/2006 | Lo et al. | |
| 2008/0231622 | A1 | 9/2008 | Honda | |
| 2010/0013746 | A1* | 1/2010 | Seto | 345/76 |

FOREIGN PATENT DOCUMENTS

| | | |
|---|---|---|
| JP | 2009-088098 | 4/2009 |
| JP | 2009080199 A | 4/2009 |
| JP | 2010-027794 | 2/2010 |
| KR | 100568597 | 9/2005 |
| KR | 20070000406 U | 1/2007 |

* cited by examiner

METHODS OF DRIVING ACTIVE DISPLAY DEVICE

CROSS-REFERENCE TO RELATED APPLICATIONS

This application claims the benefit of Korean Patent Application No. 10-2010-0111121, filed on Nov. 9, 2010, in the Korean Intellectual Property Office, the disclosure of which is incorporated herein in its entirety by reference.

BACKGROUND

1. Field

Example embodiments relate to methods of driving an active display device, which may have improved electric reliability.

2. Description of the Related Art

An active display device includes a switching transistor for controlling operations on each pixel. A thin film transistor (TFT) is generally and widely used as a switching transistor for the active display device. For example, at least one TFT is included in one pixel, and such a TFT may be classified into a silicon-TFT, an oxide TFT, an organic TFT, or the like, based on the type of semiconductor material used as a channel material. Recently, the oxide TFT, having a quicker switching speed, is generally used as the switching transistor.

A desired voltage is charged in a pixel unit for a predetermined period of time by a current flowing through a channel of the TFT (switching transistor) connected to each pixel. The charged voltage is maintained by turning off the channel after the predetermined period of time. In the case of an active matrix organic light-emitting display (AMOLED), a duration of turning on the TFT is determined by a driving frequency and resolution. If the driving frequency is 120 Hz and the resolution is a full high definition (HD) level, one TFT is turned on for 1/120/1080=7.7 μs. Also, the TFT is turned off for the remaining time of one cycle (1/120=8.3 ms). Accordingly, the TFT is turned off for the majority of time in the active display device.

Since an amorphous silicon TFT or an oxide semiconductor TFT mostly has an n-type semiconductor characteristic, a negative gate voltage is applied to turn off the TFT. Accordingly, the negative gate voltage is continuously applied to the turned off TFT in the active display device. However, if the negative gate voltage is continuously applied to the TFT for a certain period of time, a threshold voltage of the TFT may move in a negative direction. As a result, a leakage current may increase while the negative gate voltage is being applied. Such movement of the threshold voltage may be intensified if light is incident on the switching transistor. If the leakage current increases, the resolution of the active display device may deteriorate.

SUMMARY

Provided are methods of driving an active display device, which have improved electric reliability.

Additional aspects will be set forth in part in the description which follows and, in part, will be apparent from the description, or may be learned by practice of the presented example embodiments.

According to an aspect of the example embodiments, a method of driving an active display device includes recovering a threshold voltage of a switching transistor. The switching transistor being connected to a pixel. The recovering including applying a negative bias voltage to the switching transistor prior to charging each pixel during a charging period.

In an example embodiment, the negative bias voltage may be applied to a drain electrode of the switching transistor.

In a further example embodiment, the method may include applying a negative gate voltage to a gate electrode of the switching transistor for a period excluding the charging period.

In another example embodiment, the negative bias voltage may be −20 V.

Furthermore, in another example embodiment, the recovering may further include applying a positive data voltage to the switching transistor after the applying of the negative bias voltage during the charging period.

In an example embodiment, the applying of the negative bias voltage and the applying of the positive data voltage may be performed while a pulse voltage is applied to a gate electrode of the switching transistor during the charging period.

In an additional example embodiment, the applying of the negative bias voltage may be performed if a first pulse voltage is applied to a gate electrode of the switching transistor, and the applying of the positive data voltage may be performed if a second pulse voltage is applied to the gate electrode of the switching transistor during the charging period.

The active display device may be an active organic light-emitting diode.

According to another aspect of an example embodiment, a method of driving an active display device includes recovering a threshold voltage of a switching transistor connected to a pixel by applying a negative bias voltage to the switching transistor during a charging period. The method may further include charging the pixel by applying a positive data voltage to the switching transistor during the charging period.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
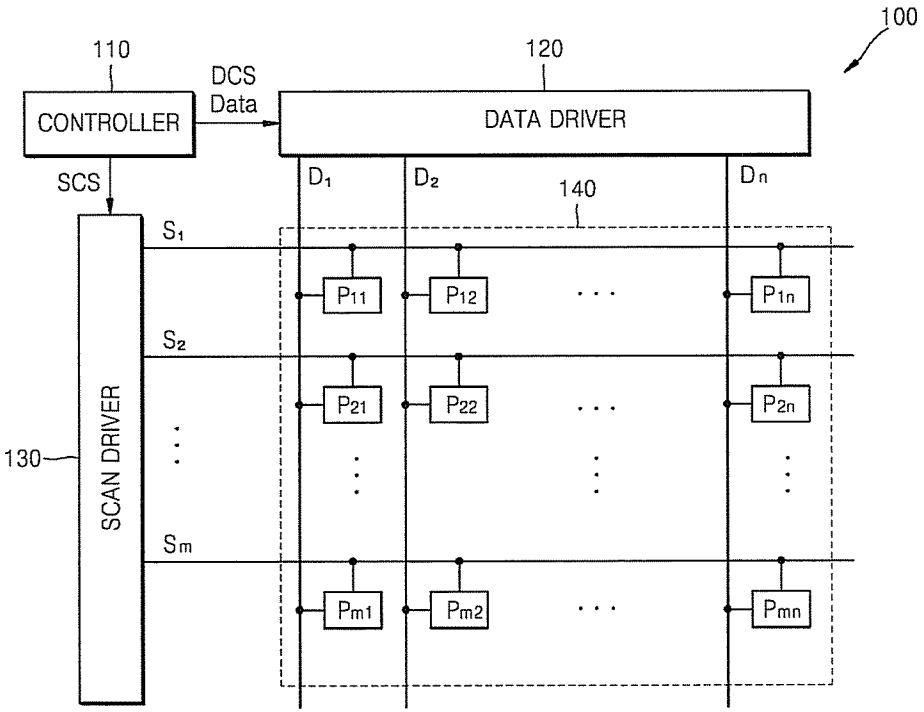
FIG. 1 diagram schematically illustrating an active display device using a method of driving an active display device, according to an example embodiment.

Example embodiments will now be described more fully with reference to the accompanying drawings, in which example embodiments are shown. Example embodiments may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. In the drawings, the thicknesses of layers and regions are exaggerated for clarity. Like reference numerals in the drawings denote like elements, and thus their description will be omitted.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items. Other words used to describe the relationship between elements or layers should be interpreted in a like fashion (e.g., "between" versus "directly between," "adjacent" versus "directly adjacent," "on" versus "directly on").

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" and/or "including," if used herein, specify the presence of stated features, integers, steps, operations, elements and/or components, but do not preclude the presence or addition of one or more other features, integers, steps, operations, elements, components and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

FIG. 1 is a diagram schematically illustrating an active display device 100 using a method of driving an active display device, according to an example embodiment.

The active display device 100 includes a controller 110, a data driver 120, a scan driver 130, and a plurality of pixels 140. As shown in FIG. 1, the plurality of the pixels 140 are arranged in an m×n matrix form.

The controller 110 generates and outputs red, green, and blue (RGB) data Data, a data driver control signal DCS, or the like to the data driver 120. The controller 110 also generates and outputs a scan driver control signal SCS, or the like to the scan driver 130.

The data driver 120 generates a jth data signal Dj from the RGB data Data or the data driver control signal DCS, and outputs the data signal Dj to the pixels Pij through a plurality of data lines D1 to Dm. For convenience of description, the reference numeral Dj denotes both a jth data signal and a jth data line. And the reference numeral Si denotes both an ith scan signal and an ith scan line. The data driver 120 may generate the data signal Dj from the RGB data Data or the data driver control signal DCS by using a gamma filter, a digital-analog converter circuit, or the like. The data signals Dj may be output to each pixel Pij disposed on the same scan line Si for one scan period. Also, each of the data lines Dj for transmitting the data signal Dj may be connected to the pixels Pij disposed on the same data line Dj.

The scan driver 130 generates and outputs a scan signal Si from the scan driver control signal SCS to the pixels Pij through a plurality of scan lines S1 to Sn. Each scan line Si transmitting the scan signal Si may be connected to the pixels Pij disposed on the same scan line Si. The scan lines Si may be sequentially driven in order of the scan lines Si. The scan driver 130 may be also referred to as a gate driver.

Each pixel Pij of the plurality of pixels 140 may include an organic light-emitting diode (OLED) and a pixel circuit for driving the OLED. A first power supply voltage VDD and a second power supply voltage VSS may be applied to each pixel within the plurality of pixels 140. Each pixel within the plurality of pixels 140 includes a switching transistor (or also referred to as a scan transistor). The scan signal Si is applied to a gate of the switching transistor.

Figure 2:
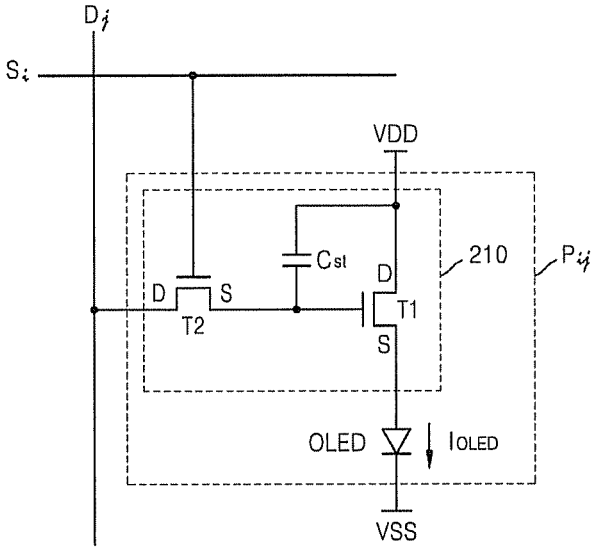
FIG. 2 is a circuit diagram of each pixel of FIG. 1.

FIG. 2 is a circuit diagram of each pixel Pij of FIG. 1. The circuit diagram of FIG. 2 is a circuit diagram of an active organic light-emitting diode.

Each pixel Pij within the plurality of pixels includes a pixel circuit 210 and a light-emitting display OLED. The pixel circuit 210 includes a driving transistor T1, a switching transistor T2, and a storage capacitor Cst.

The driving transistor T1 includes a first electrode (drain electrode) connected to a first power supply voltage VDD, and a second electrode (source electrode) connected to the OLED. The driving transistor T1 also includes a gate electrode connected to a first terminal of the storage capacitor Cst. The gate electrode of the driving transistor T1 is also connected to a second electrode (source electrode) of the switching transistor T2.

The switching transistor T2 includes a gate electrode to which a scan signal Si is applied, a first electrode (drain electrode) connected to a data line Dj for transmitting a data signal Dj. The switching transistor T2 also includes the second electrode (source electrode) connected to a gate electrode of the driving transistor T1 and a first terminal of the storage capacitor Cst.

The first terminal of the storage capacitor Cst is connected between the gate electrode of the driving transistor T1 and the second electrode of the switching transistor T2. The second terminal of the storage capacitor Cst is connected to the first electrode of the driving transistor T1.

Figure 3:
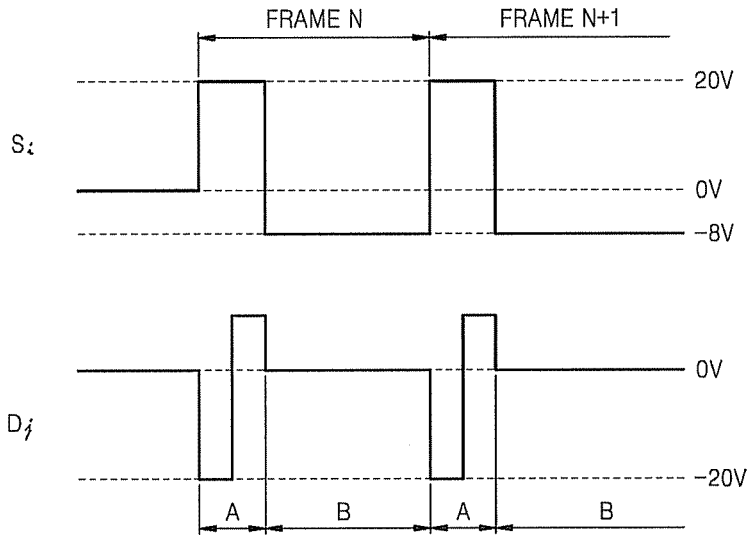
FIG. 3 is a timing diagram for describing a method of driving an active display device, according to an example embodiment.

FIG. 3 is a timing diagram for describing a method of driving an active display device, according to an embodiment.

The scan signal Si according to an example embodiment applies a voltage of about 20 V to the gate electrode of the switching transistor T2 during programming period A of each frame N, and accordingly, the switching transistor T2 is turned on. The data signal Dj is input to the first electrode of the switching transistor T2 while the switching transistor T2 is turned on. After the negative bias voltage for recovering the threshold voltage of the switching transistor T2 is applied to the data signal Dj, the positive data voltage for charging the storage capacitor Cst is applied. The negative bias voltage may be −20 V, and the positive data voltage may vary according to the data signal Dj.

Each frame includes a programming period A and a period B. The programming period A may be referred to a charging period. During the programming period A, the switching transistor T2 is turned on, and the data signal Dj is input to the gate of the driving transistor T1 and the storage capacitor Cst. During the programming period A, the storage capacitor Cst stores the positive data voltage as the data signal Dj. If the data signal Dj is applied to the gate of the driving transistor Ti, the driving transistor Ti generates and outputs a driving current $I_{OLED}$ corresponding to the data signal Dj to the OLED.

During a period B, the switching transistor T2 is turned off. In order to turn off the switching transistor T2, the negative gate voltage, for example, −8 V, may be applied to the gate of the switching transistor T2 through the scan line Si. The driving transistor Ti repeatedly or continuously generates and outputs the driving current $I_{OLED}$ to the OLED by using the data signal Dj stored in the storage capacitor Cst.

Figure 4:
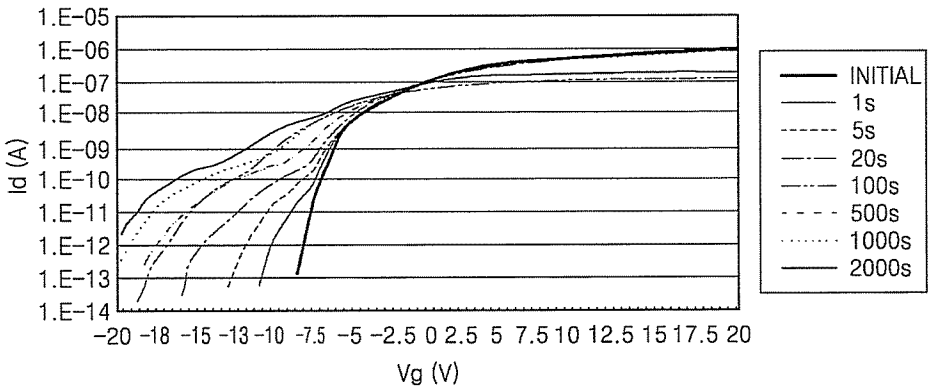
FIG. 4 is a graph showing I-V characteristics of a switching transistor according to a method of driving an active display device, which applies only a positive charging voltage during a programming period.

FIG. 4 is a graph showing I-V characteristics of a switching transistor according to a method of driving an active display device of example embodiments, which applies only a positive charging voltage during a programming period. In simulating a negative bias stress of the switching transistor, a voltage of −20 V is applied to a gate, and in simulating an optical stress, light of 8,000 cd is irradiated.

Referring to FIG. 4, while the switching transistor is turned off, a threshold voltage moves in a negative direction as a time of applying the negative bias voltage, for example, −20 V, is increased.

Figure 5:
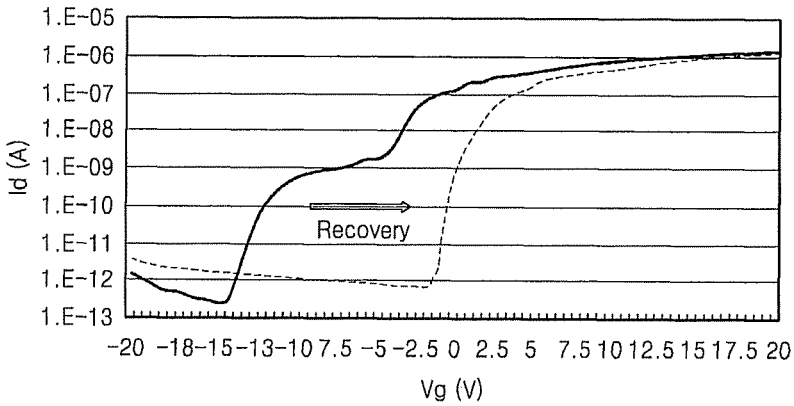
FIG. 5 is a graph for describing recovery of a threshold voltage of a switching transistor by applying a drain bias voltage according to a method of driving an active display device, according to an example embodiment.

FIG. 5 is a graph illustrating recovery of a threshold voltage of a switching transistor by applying a drain bias voltage according to a method of driving an active display device according to an example embodiment. In FIG. 5, 20 V of a gate voltage was applied, and −20 V of a drain voltage was applied to a switching transistor. Also, light of 8,000 cd was irradiated for an optical stress for 500 μs.

Referring to FIG. 5, the threshold voltage was recovered by applying a negative bias voltage to a first electrode (drain electrode) during programming of the switching transistor connected to each pixel.

A plurality of switching transistors were generally used to alternatively apply a bias voltage to a gate electrode of the switching transistors, but such a method requires a plurality of switching transistors. However, in the current example embodiment, the threshold voltage of the switching transistor, which is moved in the negative direction, is recovered by using one switching transistor.

Accordingly, electric reliability of the switching transistor is improved, and as a result, the lifetime of the active display device may be increased.

Figure 6:
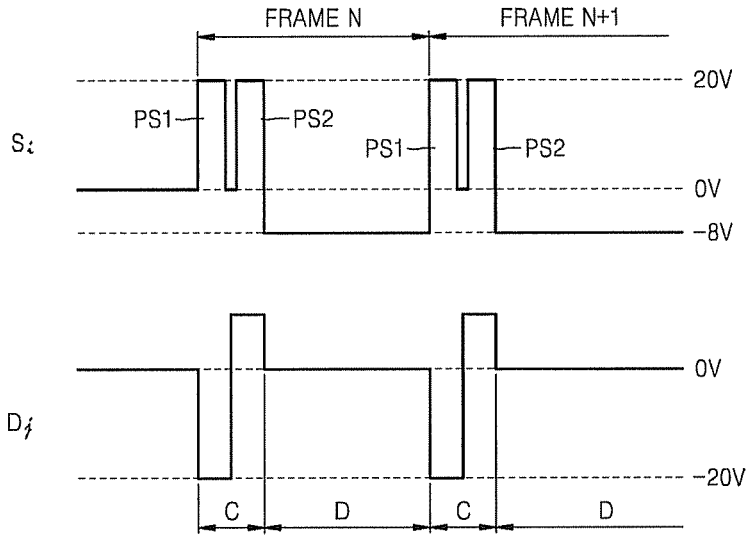
FIG. 6 is a timing diagram for describing a method of driving an active display device, according to another example embodiment.

FIG. 6 is a timing diagram for describing a method of driving an active display device according to another example embodiment. Like reference numerals refer to like elements in FIGS. 1, 2, and 6, and thus, descriptions thereof will not be repeated.

Referring to FIG. 6, a first pulse voltage PS1 and a second pulse voltage PS2 are supplied by the scan signal Si during the programming period C. The switching transistor T2 is turned on when the first pulse voltage PS1 is supplied.

While the first pulse voltage PS1 is supplied, a negative bias voltage of −20 V is applied to the drain electrode of the switching transistor T2 by the data signal Dj. Accordingly, distortion of the threshold voltage of the switching transistor T2 is recovered.

While the second pulse voltage PS2 is supplied to the switching transistor T2, a positive data voltage is applied to the drain electrode of the switching transistor T2 by the data signal Dj. Accordingly, the positive data voltage applied to the switching transistor T2 is input to the gate electrode of the driving transistor T1 and the storage capacitor Cst. During the programming period C, the storage capacitor Cst stores the positive data voltage by the data signal Dj. If the data signal Dj is applied to the gate of the driving transistor T1, the driving transistor T1 generates and outputs the driving current $I_{OLED}$ corresponding to the data signal Dj to the OLED.

The switching transistor T2 is turned off during the period D. In order to turn off the switching transistor T2, the negative gate voltage, for example, −8 V, may be applied to the gate electrode of the switching transistor T2 through the scan line Si. The driving transistor T1 repeatedly or continuously generate and output the driving current $I_{OLED}$ to the OLED by using the data signal Dj stored in the storage capacitor Cst.

While example embodiments have been particularly shown and described, it will be understood by one of ordinary skill in the art that variations in form and detail may be made therein without departing from the spirit and scope of the claims.

What is claimed is:

1. A method of driving an active display device, the method comprising:

turning on a switching transistor connected between a data line and a driving transistor, a period during which the switching transistor is on being a charging period;

recovering a threshold voltage of the switching transistor, the switching transistor connected to a pixel, the recovering including applying a negative bias voltage to the switching transistor prior to applying a data signal during the charging period, the recovering occurring at the beginning of the charging period; and applying a positive data voltage to the switching transistor during the charging period, the positive data voltage being higher than the negative bias voltage during a period excluding the charging period, the switching transistor being in an off state after the recovering and prior to the applying the positive data voltage, wherein the recovering and the applying of the positive data voltage are substantially successively performed.

2. The method of claim 1, wherein the negative bias voltage is applied to a drain electrode of the switching transistor.

3. The method of claim 2, further comprising:

applying a negative gate voltage to a gate electrode of the switching transistor for a period excluding the charging period.

4. The method of claim 1, further comprising:

applying a negative gate voltage to a gate electrode of the switching transistor for a period excluding the charging period.

5. The method of claim 1, wherein the negative bias voltage is −20 V.

6. The method of claim 1, wherein the applying the negative bias voltage is performed while applying a first pulse voltage to a gate electrode of the switching transistor and the applying the positive data voltage is performed while a second pulse voltage is applied to the gate electrode of the switching transistor during the charging period, the switching transistor being in the off state after the first pulse voltage is applied to the gate electrode and before the second pulse voltage is applied to the gate electrode.

7. The method of claim 1, wherein the applying the negative bias voltage is performed when a first pulse voltage is applied to a gate electrode of the switching transistor, and the applying the positive data voltage is performed when a second pulse voltage is applied to the gate electrode of the switching transistor during the charging period, the switching transistor being in the off state after the first pulse voltage is applied to the gate electrode and before the second pulse voltage is applied to the gate electrode, and the switching transistor is set to the off state after the second pulse voltage is applied to the gate electrode.

8. The method of claim 1, wherein the active display device is an active organic light-emitting diode.

* * * * *